United States Patent [19]

Hinden

[11] Patent Number: 4,932,177

[45] Date of Patent: Jun. 12, 1990

[54] ROOM DIVIDER

[75] Inventor: Peter Hinden, Remigen, Switzerland

[73] Assignee: Emb Ru-Werke, Mantel & Cie, Ruti, Switzerland

[21] Appl. No.: 302,807

[22] Filed: Jan. 27, 1989

[30] Foreign Application Priority Data

Jan. 28, 1988 [CH] Switzerland ..... 290/88

[51] Int. Cl.[5] ..... E02G 3/00; E04H 1/00

[52] U.S. Cl. ..... 52/221; 52/239; 174/48; 160/351

[58] Field of Search ..... 52/238.1, 239–242, 52/282, 220, 221; 160/135, 351; 174/48, 49; 312/239, 198, 208, 237

[56] References Cited

U.S. PATENT DOCUMENTS 3,209,869 10/1965 Hammitt ..... 52/239 X
3,289,368 12/1966 Mark ..... 52/220
3,844,079 10/1979 Karrid ..... 52/221
4,771,583 9/1988 Ball et al. ..... 52/221

*Primary Examiner*—Richard E. Chilcot, Jr.
*Attorney, Agent, or Firm*—Kinzer, Plyer, Dorn, McEachran & Jambor

[57] ABSTRACT

The room divider comprises an independently stable, positionally secure skeleton of carrying columns (1) and cable channels (2) connected with them. The upper edge of the channels (2) is about at desk height, and the columns (1) overhang the channels (2). In this skeleton there are installed changeable separating elements (4), for example cabinet elements (40), drawer elements (41) or wall elements (42). Through this structure there is present at desk height a large, very well opened-up working surface for the accommodating, operating and stowing of electronic equipment units, so that the desk (6) is freed of encumbrances. The space divider can easily be adapted to changing requirements.

11 Claims, 5 Drawing Sheets

ROOM DIVIDER

Figure 1:
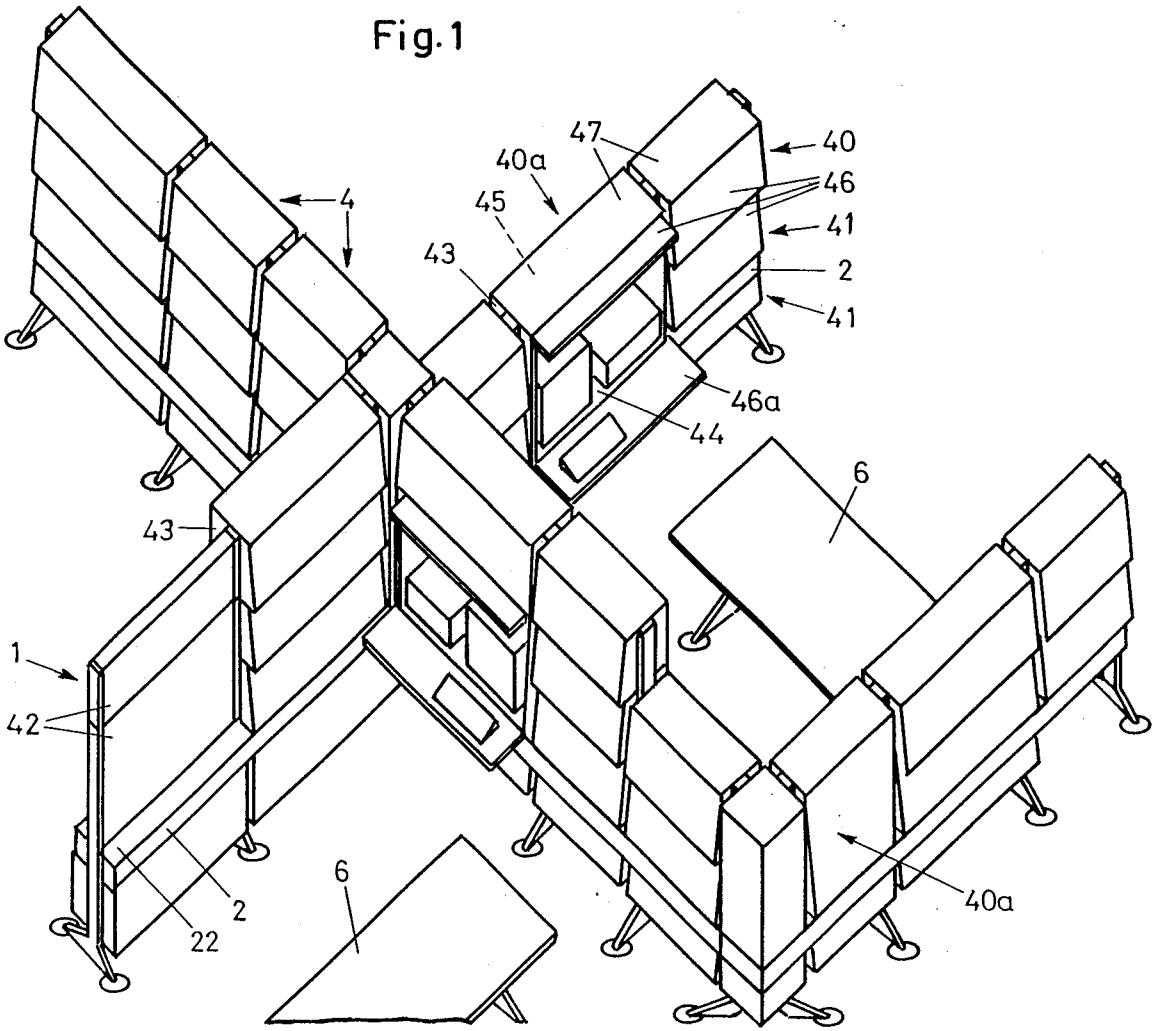

In modern office spaces many electronic units must be connected with one another, with the main system as well as with external devices. For this purpose modern office desks have cable channels in the desk frame. In them cables can be stowed and conducted so that the apparatus units placed on the desk can be connected conveniently. This solution is well suited for work areas in which the work has to be done predominantly with the entire set of instruments or units. If, however, individual units are used relatively seldom, then these either take up an unnecessary amount of space on the desk or they must in each case be taken out and connected, which is complicated.

Underlying the present invention is the problem of forming office working spaces in such a way that the desks can be relieved and nevertheless an optimal access to the electronic units is possible.

With the construction according to the invention the cable channels in the desks are superfluous. When the desk is pushed up to the room divider a cable can be led directly from the cable channel of the room divider to the desk. Furthermore, now all the electronic devices can be installed in cabinet elements in the room divider. Since the upper edge of the cable channel is arranged approximately at desk height, a working surface can be arranged on it directly, for example for a keyboard or a picture screen. The connecting cables can then be very simply stowed. Units used only occasionally are stowed in a cabinet element and remain connected. The solution according to the invention is extremely flexible, so that the individual working space can easily be adapted to the requirements of the user as well as to the requirements dictated by new working units or work cycle.

Room dividers for subdividing a large area office into individual working spaces have been known for a relatively long time. The room divider described in U.S. Pat. No. 3,471,629 consists of wall elements that are suspended on carrying columns. On the upper edge of the wall elements there is placed a cable channel. Over vertical branch channels laid in the wall elements an electrical connecting line can be led from the floor into the cable channel or a branch line from the cable channel to the work places. The laying of the cables here is very expensive, because for the drawing of the cables through the narrow pipe channels in the wall elements the plugs have to be removed.

Figure 2:
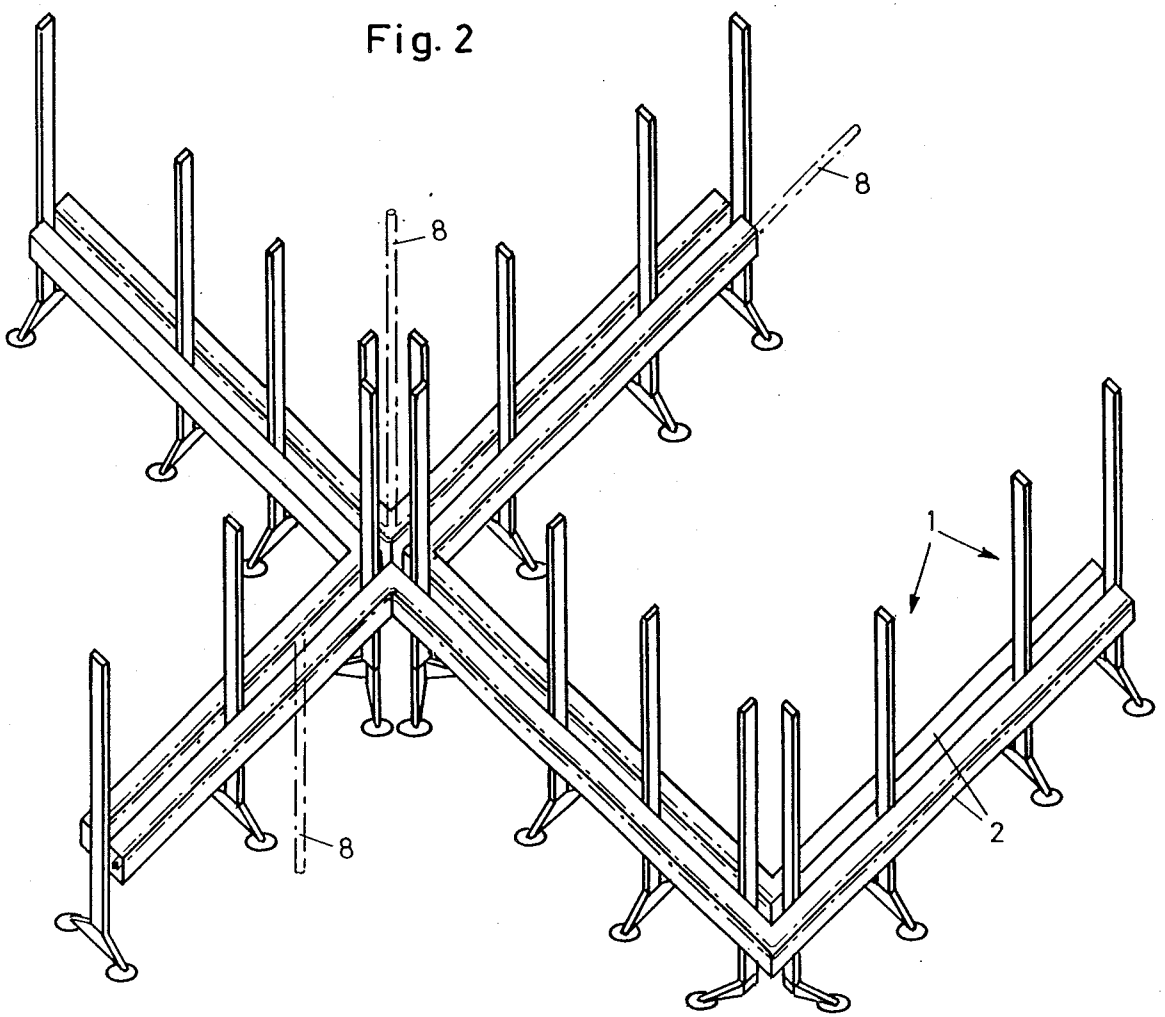
Figure 3:
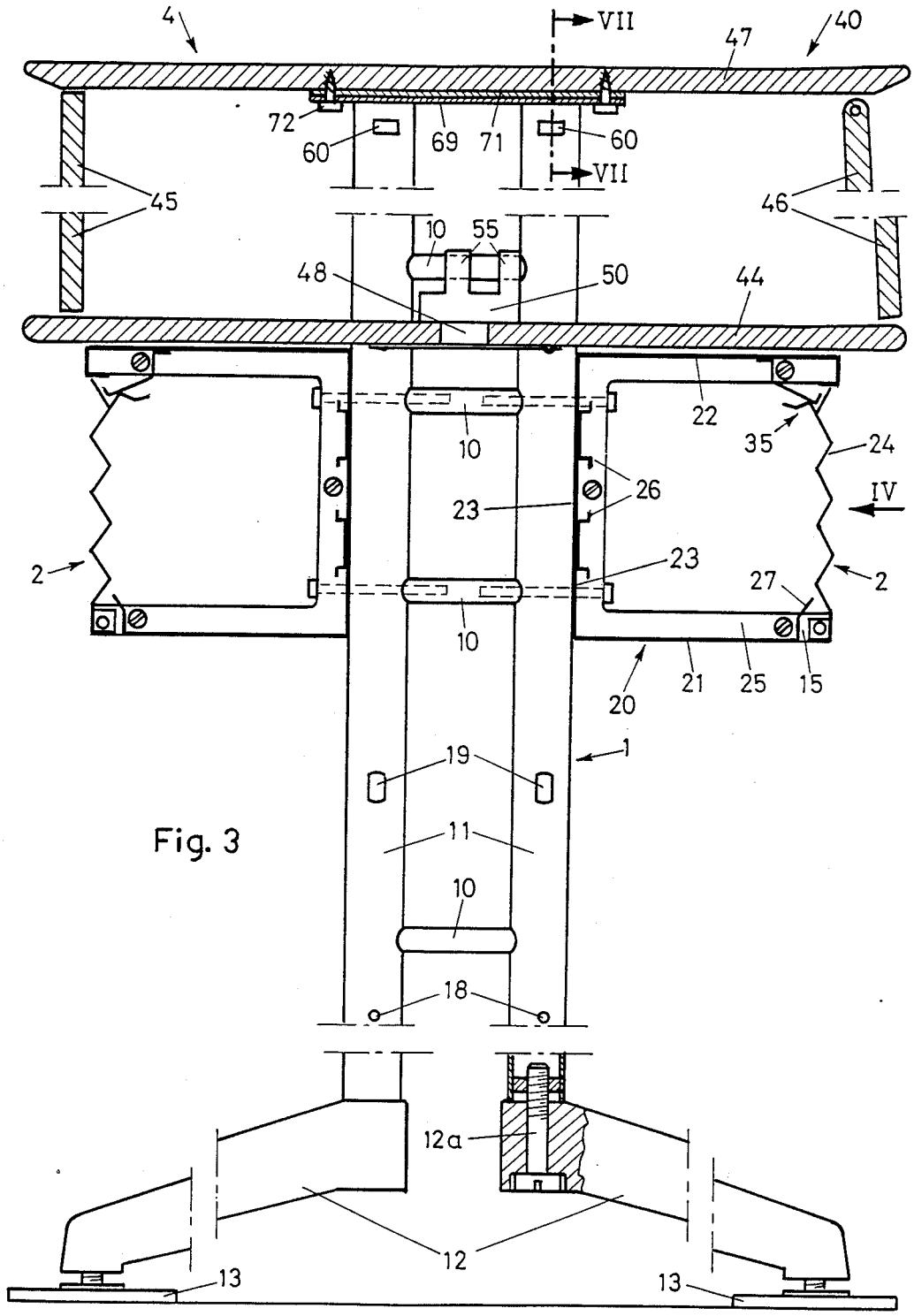
Figure 4:
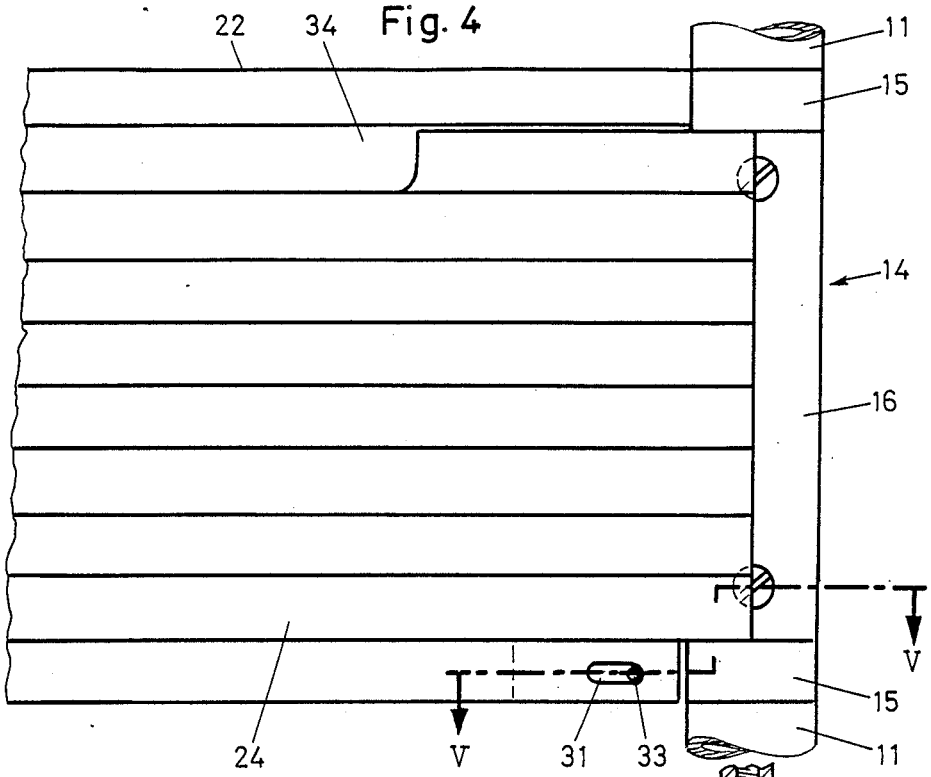
Figure 5:
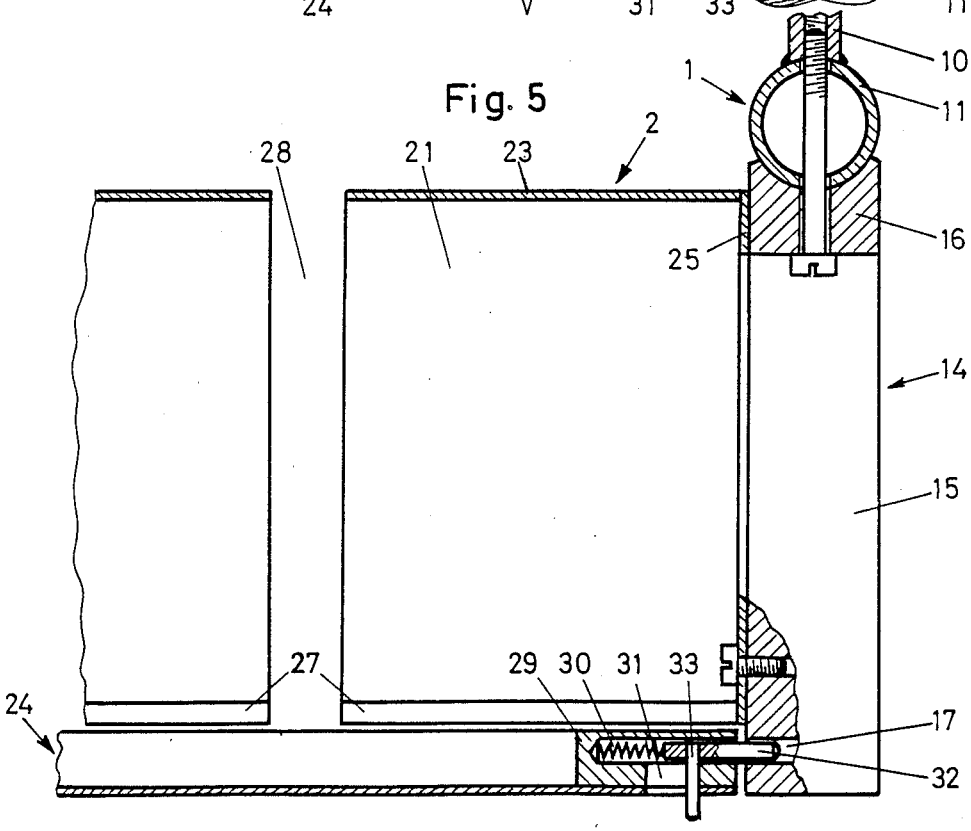
Figure 6:
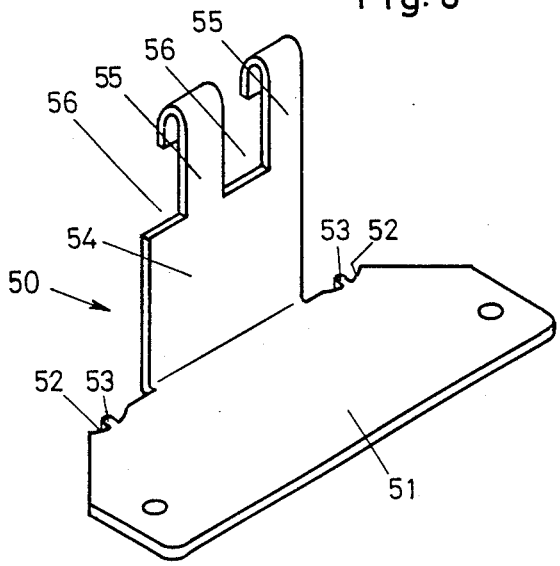
Figure 7:
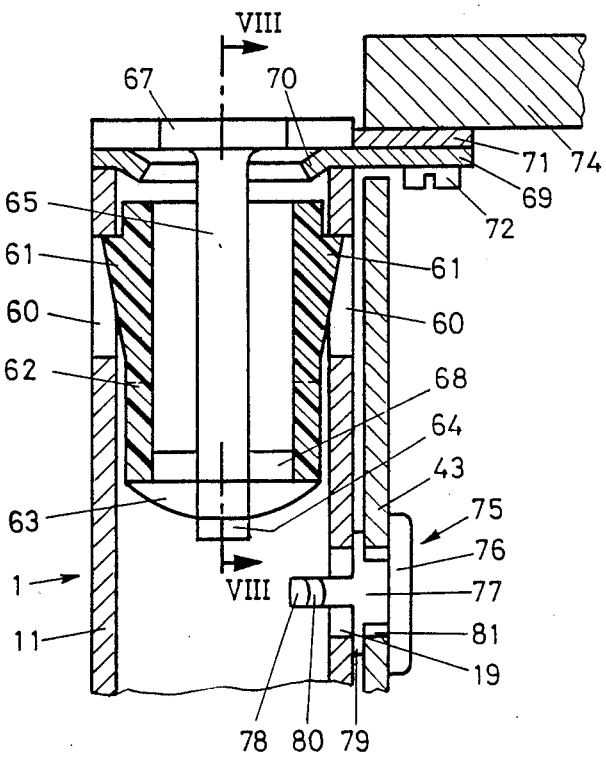

In the following an example of execution of the invention is explained with the aid of the drawing. In this:

FIG. 1 shows a perspective view of a space subdivided with a room divider according to the invention;

FIG. 2 a perspective view of the skeleton of the room divider according to FIG. 1;

FIG. 3 a cross section through a room divider according to FIG. 1;

FIG. 4 a side view of a cable channel;

FIG. 5 a cross section along the line V—V in FIG. 4;

FIG. 6 a perspective view of a rack board carrier;

FIG. 7 a section along the line VII—VII in FIG. 3; and

Figure 8:
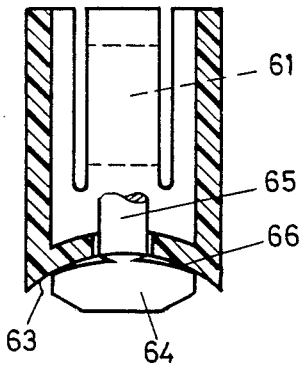

FIG. 8 a section along the line VIII—VIII through the holder.

The room divider according to FIG. 1 is constructed modularly on a base grid and consists of carrying columns 1, a cable channel 2 and separating elements 4. The separating elements 4 may be wall elements 42, for example of sound-absorbing material. At least some of the separating elements 4, however, are constructed as supply bodies 40, 41 for the reception of office utensils, for example as cabinet element 40 or drawer element 41. Cabinet and drawer elements 40, 41 are constructed modularly and consist in each case of two side walls 43 of sheet metal, which are screwed fast laterally to a rack board 44 and a back wall 45. They contain a front plate 46. In drawer elements 41 the front plate 46 is horizontally withdrawable, in cabinet elements 40 swingable along their upper edge and slidable inward in the swung-up position. In high cabinet elements **40*a*, for example for large picture screens, additionally the lower half 46*a* of the front plate is swingable down into a horizontal position. The front plates 46 are slightly slanted downward to the outside. This simplifies the closing mechanics for the pivotable front plates 46, 46*a*, because for the holding of the front plates in the closed positions merely stops are required. As upper closure covers 47 are fastened to the columns 1 over the elements 40, 41**.

From FIG. 2 it is evident that on both sides of the columns 1 there is fastened in each case a cable channel 2. The two channels 2 are arranged at the same height with spacing from one another. Their upper edge is approximately at the height of a desk 6, i.e. at 50 cm to 80 cm from the floor. A height of 68 cm from the floor has proved especially suitable. The cable channels 2 are detachably connected with the columns 1, for example screwed in place. Columns 1 and channels 2 form together a rigid, stable, sturdy skeleton that requires no fastening to wall or ceiling. In the skeleton there are suspended the separating elements 4. As is indicated in FIG. 2, cable strands 8 can be introduced through the face sides of the cable channels 2 from below or from above into the cable channels 2, in the latter case, for example, over a branch, cross-place or bend-off place over the requisite special separating element.

In FIG. 3 there is represented a vertical section through the room divider on a somewhat larger scale, in which for better perspicuity the side walls 43 of the separating elements 4 indicated only above the cable channels 2 are omitted. The carrying column 1 consists of two pipes 11 with circular cross section welded together over round, horizontal connecting rods 10 of smaller diameter. To the lower pipe end there is screwed a transversely protruding foot 12. After release of the screw **12*a* the foot 12 can be rotated about the pipe axis. At the free end a stand plate 13 is screwed into the foot 12. The plate 13 has a relatively large diameter, so that the weight of the room divider is adequately distributed and soft carpet floors are not damaged. By screwing out or in of the plates 13 the skeleton consisting of columns 1 and channels 2 can be adjusted. Through the relatively far-projecting feet 12 a high stability is achieved, even if the room divider is set up little branched and bent-off. Because the foot 12** can be rotated about the pipe axis and arrested, despite its further projection disturbances at corners or free ends of the room divider can be avoided.

On both pipes 11 there is screwed fast a U-shaped, massive cable channel carrier 14 (FIG. 5). The two shanks 15 of the carrier 14 are horizontal. The vertical crosspiece 16 of the carrier 14 is concave-cylindrical and lies against the pipe 11. The lower shank 15 has a transverse bore 17 at the free end. Between the two like-directed carriers 14 of adjacent columns 1 there is seated a cable channel element 20 consisting of a substantially U-shaped, laterally open profile piece of sheet metal with a base plate 21, a horizontal cover plate 22 and a back wall 23, as well as of a shutter 24. On the base and cover plate 21, 22 and the back wall 23 there is welded on both sides a U-shaped flange plate 25 which is screwed fast to the carrier 14. On the back wall 23 there are welded two horizontal holding rails 26 for electrical units, for example cable clamps or plug sockets. The base plate is bent up into a flange 27 for reinforcement and for the retaining of cables. In the base plate 21 there is stamped out at least one break-through 28, which extends from the free edge of the flange 27 on into the back wall 23 about to the lower holding rail 26. The shutter 24 has continuous horizontal reinforcing corrugations, triangular in cross section. On its lower edge there is welded on both sides a hinge block 29 with a longitudinal bore 30 and a lengthwise slit 31 to the shutter plate. In the bore 30 there is conducted a spring-urged hinge pin 32. The pin 32 extends into the bore 17 and can be withdrawn from the bore 17 by actuation of a transverse pin 33. Therewith the shutter 24 is easily removable and cables can be led in or led out through the break-throughs 28 without having to be threaded. In the event that cables are to emerge to the front out of the cable channel 2, cable lead-through openings 34 are cut out on the free edge of the shutter 24, which serve also as grip for the opening of the shutter 24. For holding the shutter 24 in the closed position there serves a snap element 35.

The separating elements 4 are borne on both sides by a rack board carrier 50 of sheet metal bent in L-shape (FIG. 6). The lower, horizontal shank 51 of the carrier 50 has two circular-segmental recesses 52 for engagement on the two pipes 11. From each of these recesses 52 there protrudes a projection 53, which in the mounted state engages into corresponding transverse bores 18 (FIG. 3) in the pipes 11 underneath one of the connecting rods 10. On the vertical shank 54 there are two fingers 55 bent around through 180°. These fingers 55 in the mounted state grip around one of the connecting rods 10 and transfer the load to this rod. The fingers 55 are asymmetrically constructed and leave open on the one side and between them in each case a free gap 56, which is wider than the finger width. Thereby on the same connecting rod 10 two identical carriers 50 can be suspended in mirror image to the middle plane of the columns 1. The fingers 55 of the one carrier fit into the gaps 56 of the other. When the carriers 50 are installed and a rack board 44 is emplaced on the carriers 50, the carriers 50 are fixed in position and cannot move or swing in any direction. The installed elements 4 are hereupon fixed in position still by bayonet locks which grip through the side walls 43 and engage into oblong holes 19 (FIG. 3) in the pipes 11.

The rack plates 44 of cabinet elements 40 arranged over the cable channels 2 have a lengthwise slit 48 (FIG. 3) for the lead-through of cables. These cabinet elements are especially suited for the reception of electronic working apparatuses, because their rack plate 44 is at convenient desk height and the connecting cables can be led via the slit 48 and one of the break-throughs 28 directly into the cable channel.

As is illustrated in FIGS. 7 and 8, the covers 46 are fastened securely against break-in on the two pipes 11 of the column 1. At the upper end rectangular openings 60 are stamped out in the pipes 11. Into the openings 60 there are snapped lugs 61 of a holder 62. The holder 62 consists of a stable plastic. Its lower face end 63 is concave-cylindrical. On it there engages a crosspiece 64 of a clamping bolt 65. The crosspiece 64 has, facing the face end 63, a spherical surface 66. At the upper end the clamping bolt 65 has a hexagonal head 67. In assembling, the crosspiece 64 is inserted through an axial oblong hole 68 in the holder 62 and then turned through 90°. Through the spherical surface 66 the head 67 is drawn downward somewhat so that it clamps firmly to the pipe 11 a cover carrier 69 emplaced on the pipe 11. Expediently the cover carrier 69 is centered on the two pipes 11, for example by an impressed countersinking 70. On the cover carrier 69 there is placed a security plate 71. This grips snugly around the hexagagon heads 67. Carrier 69 and plate 71 have aligned passage bores through which the cover 47 is screwed fast from underneath with screws 72. The clamping bolts 65 are therewith secured against twisting and the cover 47 can be removed only by releasing of the screws 72, i.e. after the opening of the cabinet or drawer element 40, 41, possibly with the fitting wrench. Thereby the cabinet and drawer elements 40, 41 are secure against break-in, i.e. a break-in in any case is possible only by application of force and could not remain undiscovered.

In FIG. 7 there is represented a form of execution of the cover carrier 69 for the case in which the column 1 is an end column. If, however, covers 47 follow on both sides upon the column , then the cover carrier 69 overhangs the pipes 11 symmetrically on both sides. So that the two covers 47 will be flush, security plates 71 are placed on both sides, although for security only on plate 71 would be required.

As is to be seen from FIG. 7, the side wall 43 of the cabinet and drawer elements 40, 41 are joined by means of a bayonet rapid connector 75 with the pipe 11. The connector 75 has a round, disk-form head 76 with an inside hexagon for the engagement of an Inbus (socket-head cap-screw) wrench. On the shaft 77 of the connector 75 there are molded two bolts 78, 79 offset against one another by 90°. The first bolt 78 on the free shaft end is constructed for the passage through the oblong hole 19 in the pipe 11 and after the turning of the connector 75 grips with a spherical engagement surface 80 behind the inner wall of the pipe 11. The second bolt 79 is longer than the first and is thrust in the turning between the pipe 11 and the side wall 43. The opening 81 in the side wall 43 for the passage of the bolt 79 is unround and has its greatest width in horizontal direction. Through this construction of the connector 75 there is present a spacing between the column 1 and the side wall 43. The supply bodies 40, 41 are, therefore, somewhat shorter than the clear space between adjacent columns 1. Thereby there is made possible a simple installation and removal of the supply bodies 40, 41.

The room divider described can be adapted extremely easily to changing requirements, because the separating elements 4 can be rapidly exchanged for others without it being necessary for the purpose for the skeleton consisting of the columns 1 and the cable channels 2 to be disassembled. Thanks to the great stability, the room divider is very simple to assemble and within the given grid there can be realized arbitrary space articulations. Through the preferably closed, large possible working area at desk height the electronic working units can be optimally used and the desk 6 becomes free of cables and other equipment. Through the modular structure of the supply bodies 40, 41 it is possible to exchange also individual parts of these bodies, for example the back wall. The supply bodies 40, 41 can be used at will from one or both sides, so that the room divider is alternately usable.

In the example of execution represented the pipes 11 of the columns 1 are one-piece in height. They can, however, also be subdivided into several part pieces, which are joined with one another detachably by pipe connectors. The lowest separating place may be, for example, at the level of the upper edge of the cable channel 2. Through this construction there is achieved a still greater flexibility in the setting up of the room divider.

I claim:

1. Room divider comprising a plurality of carrying columns (1), separating elements (4) inserted between two adjacent columns (1) and removably fastened to the columns (1), and channel sections (20) extending from one of the columns (1) to the adjacent column (1), wherein each channel section (20) comprises a profile of substantially U-shaped, laterally open cross section defining a horizontal upper plate (22) located at a height of 50 to 80 cm above ground, a back wall (23) and a base plate (21), and a shutter (24) removably inserted between the free edge of the upper plate (22) and the free edge of the base plate (21), said profile being fastened at both of its ends to one of said columns respectively laterally offset with respect to a vertical center plane extending through these two columns such that adjacent channel sections (20) form a substantially unrestricted, through going channel (2), said base plate (21) having at least one slit (28) for inserting cables and extending from the free edge of the base plate (21), said columns (1) and said channel sections (20) forming a stable, independently free-standing skeleton supporting said separating elements (4), wherein at least some of said separating elements (4) are receptacles (40,41) for storing office utensils.

2. Room divider according to claim 1, characterized in that to each column (1) at the bottom there are fastened two laterally protruding feet (12).

3. Room divider according to claim 2, characterized in that each foot (12) is swingable about a vertical axis and is fixable in position.

4. Room divider according to claim 3, characterized in that each column (1) consists of two vertical pipes, vertically spaced and joined with one another.

5. Room divider according to claim 4, characterized in that the two pipes (11) of each column (1) are joined with one another by horizontal connecting rods (10) whose thickness is less than the diameter of the pipes (11), that the separating elements (4) rest on rack board carriers (50) which have a horizontal shank (51) and a vertical shank (54) which at its upper end has hook-shaped fingers (55), which are suspended on one of the connecting rods (10), wherein the horizontal shank (51) has two recesses (52) abutting on the two pipes (11) with a projection (53) each engaging into a transverse bore (18) in the pipes (11).

6. Room divider according to claim 1, characterized in that the section of the columns (1) projecting above the cable channel (2) forms one piece with the lower column section.

7. Room divider according to claim 1, wherein a further, identical channel section (20) is fastened to two adjacent columns (1) at the same height as and symmetrically to the first mentioned channel section (20) with respect to said center plane, said two channel sections (20) between adjacent columns (1) forming a gap between them.

8. Room divider according to claim 1, wherein at least one of said receptacles 40 is mounted immediately above said channel section (20) and comprises a rackboard (44), two side walls (43) and a back plate (45), said rackboard (44) having a slot (48) extending substantially in said center plane, said side walls being removably fastened to the respective columns (1).

9. Room divider comprising several carrying columns (1), separating elements (4) inserted between two adjacent columns (1) and fastened to the columns (1), and a cable channel (2) having an upper edge, characterized in that the columns (1) project above the cable channel (2) in height, that the upper edge of the cable channel (2) is above floor level, and that the columns (1) are joined with the cable channel (2) into a stable, independently free-standing skeleton suspending the separating elements (4), wherein at least some of the separating elements (4) are constructed as supply bodies (40, 41) for the reception of office utensils; further characterized in that the side walls (43) of the supply bodies (40, 41) are joined with the columns (1) by bayonet rapid connectors (75), which have a head (76), a first bolt (78) gripping behind the column (1) and a second bolt (19) engaging between the column (1) and the side wall (43), and that the length of the supply body (40, 41) is less than the clear distance between adjacent columns (1).

10. Room divider comprising several carrying columns (1), separating elements (4) inserted between two adjacent columns (1) and fastened to the columns (1), and a cable channel (2) having an upper edge characterized in that the columns (1) are each constructed of two laterally spaced and joined vertical pipes (11) which project above the cable channel (2) in height and have laterally projecting feet (12) each swingable about a vertical axis to a fixed position, that the upper edge of the cable channel (2) is arranged above floor level, that the columns (1) are joined with the cable channel (2) into a stable, independently free-standing skeleton suspending the separating elements (4), wherein at least some of the separating elements (4) are constructed as supply bodies (40, 41) for the reception of office utensils; further characterized in that the cable channel (2) consists of a pair of individual elements (20) which extend from one of the columns (1) to the adjacent column (1) and are fastened to said columns on opposite sides of the columns in spaced relation to one another; further characterized in that each cable channel element (20) comprises a profile piece substantially U-shaped in cross-section, laterally open, presenting a base plate (21), a horizontal cover plate (22) and a back wall (23), that along the free edge of the base plate (21) a shutter (24) is removably articulated, that the base plate (21) has breakthroughs (28) for inserting cables which extend from the free edge of the base plate (21) up to the back wall (23), and that in the closed position of the shutter (24), between its free edge and the free edge of the cover plate (22), there are formed cable lead-through openings (34); and further characterized in that the two pipes (11) of each column (1) are joined with one another by horizontal connecting rods (10) having a thickness less than the diameter of the pipes (11), that the separating elements (4) rest on rack board carriers (50) which have a horizontal shank (51) and a vertical shank (54) which at its upper end has hook-shaped fingers (55) which are suspended on one of the connecting rods (10), wherein the horizontal shank (51) has two recesses (52) abutting on the two pipes (11) with a projection (53)

each engaging into a transverse bore (18) in the pipes (11).

11. Room divider according to claim 10, characterized in that the uppermost separating elements (4) are closed off by covers (47), that each cover (47) rests on both sides upon a cover carrier (69), that each cover carrier (69) is emplaced on the two pipes (11) of one of the columns (11) and is clamped fast by a clamping member (65) provided with wrench engagement elements (67), engaging into the pipe (11) by a rotary movement about the pipe axis, that a security plate (71) engaging snugly into the wrench engagement elements (67) is inserted between the cover carrier (69) and the cover (47) and is fastened in common with the cover carrier (69) to the cover (47) by a releasable fastening element (72) accessible only from underneath.

* * * * *

UNITED STATES PATENT AND TRADEMARK OFFICE

CERTIFICATE OF CORRECTION

PATENT NO. : 4,932,177

DATED : June 12, 1990

INVENTOR(S) : Peter Hinden

It is certified that error appears in the above—identified patent and that said Letters Patent is hereby corrected as shown below:

On the title page, column one of the patent, change "Assignee: Emb Ru-Werke, Mantel & Cie,"

to --Assignee: Embru-Werke, Mantel & Cie--.

Signed and Sealed this

Eighteenth Day of June, 1991

*Attest:*

*Attesting Officer*

HARRY F. MANBECK, JR.

*Commissioner of Patents and Trademarks*